United States Patent [19]

Anderson

[11] Patent Number: 4,541,468

[45] Date of Patent: Sep. 17, 1985

[54] TILTER MECHANISM FOR A SLATTED BLIND

[75] Inventor: Richard N. Anderson, Owensboro, Ky.

[73] Assignee: Hunter Douglas, Inc., Owensboro, Ky.

[21] Appl. No.: 543,341

[22] Filed: Oct. 19, 1983

[51] Int. Cl.[4] ..... E06B 9/38

[52] U.S. Cl. ..... 160/177

[58] Field of Search ..... 160/166–178

[56] References Cited

U.S. PATENT DOCUMENTS

| | | | |
|---|---|---|---|
| 2,493,234 | 1/1950 | Dunn | 160/176 |
| 2,809,531 | 10/1957 | Moyer | 160/177 |
| 2,849,062 | 8/1957 | Bonsteel | 160/176 |
| 4,140,169 | 2/1959 | Arena | 160/178 R |

*Primary Examiner*—Peter M. Caun

*Attorney, Agent, or Firm*—Pennie & Edmonds

[57] ABSTRACT

A tilter mechanism for a slatted blind where the mechanism has a worm gear rotatably mounted in a first mounting means and a toothed worm wheel rotatably mounted in a second mounting means and in normal meshing engagement with the worm gear. The toothed wheel has a consecutive series of teeth of lesser height than the remainder of the teeth. Resilient means are provided with at least one of the mounting means to allow the wheel to move relatively away from the gear so that the gear may slip over the shortened teeth to act as a slip clutch.

5 Claims, 3 Drawing Figures

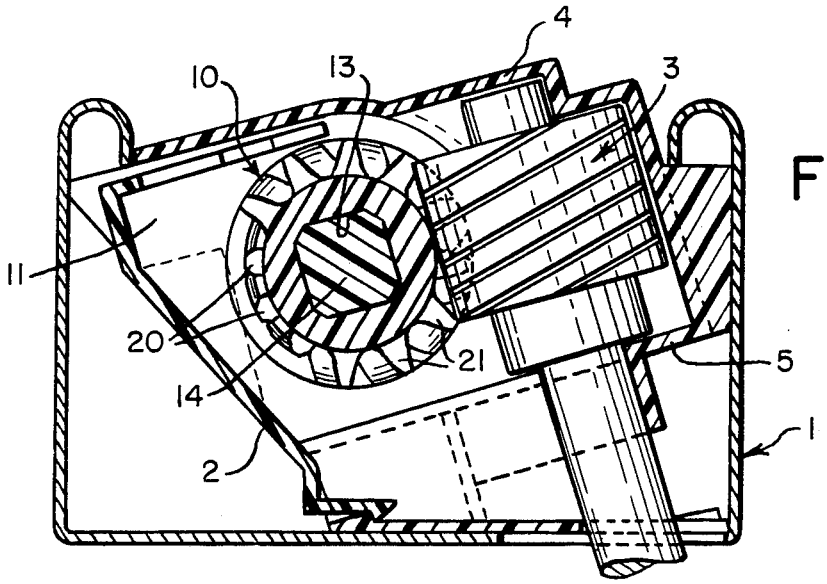
FIG. 1
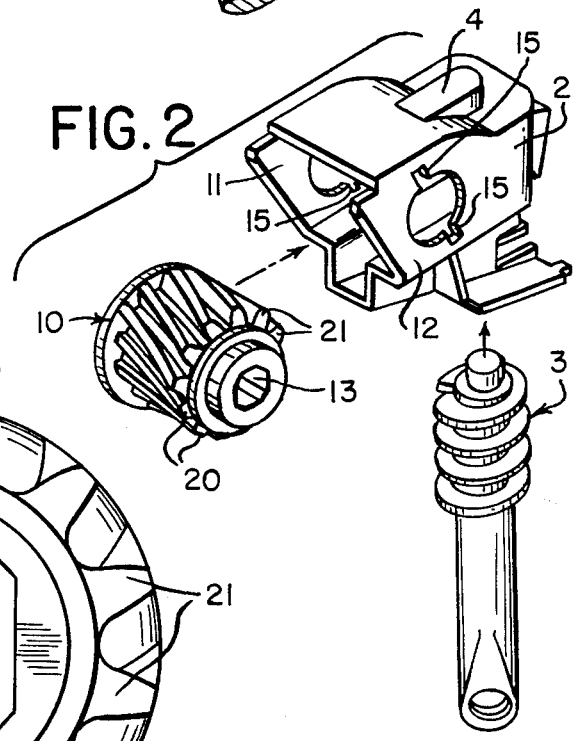
FIG. 2
FIG. 3
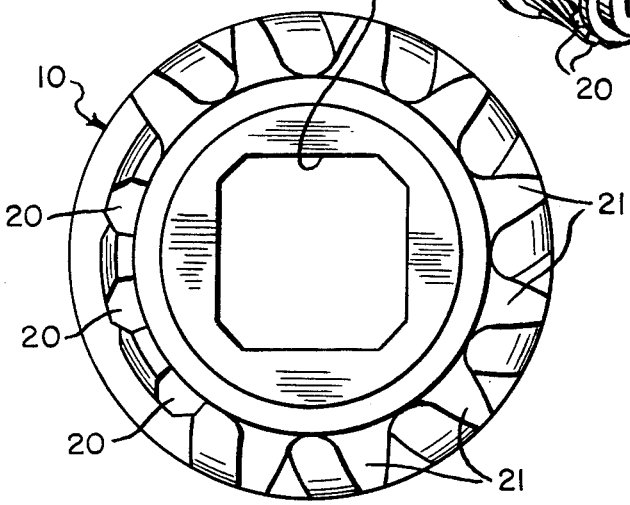

TILTER MECHANISM FOR A SLATTED BLIND

FIELD OF THE INVENTION

This invention relates to a tilter mechanism for a slatted blind and more particularly to a tilter mechanism having a slip construction acting as a slip clutch to prevent binding or jamming of the tilter mechanism when the slats of a slatted blind have been tilted to their limit.

CROSS-REFERENCE TO OTHER APPLICATIONS

This application relates to similar subject matter disclosed in my copending application Ser. No. 492,392 filed May 6, 1983.

BACKGROUND OF THE INVENTION

Tilter mechanisms for slatted blinds have in the past utilized a worm gear in meshing engagement with a worm wheel to provide for the transfer of forces necessary to tilt the slats of a venetian blind assembly. It has been customary in such mechanisms to have the toothed worm wheel connected to a tilt bar which in turn tilts the slats while the worm gear is connected to an operating member such as a wand. Upon rotation of the wand by an operator, forces are transmitted from the wand via the worm gear to rotate the worm wheel and consequently the tilt bar which in turn tilts the slats.

In order to prevent jamming of the mechanism when the slats have been tilted to their full degree or limit of tilt to a closed position as might occur if forces are continued to be applied to the wand, the worm wheel in such prior mechanisms has had a blank portion on its periphery which is void of any teeth. The result is that when the slats reach their limit of tilt, the blank portion will be opposite the teeth of the worm gear such that there is disengagement of the worm gear with respect to the worm wheel so that no further force may be applied to the worm wheel which might result in jamming or binding and resultant damage to the mechanism. This provision of having a blank untoothed portion in the toothed worm wheel has not proved entirely satisfactory since, in many instances, the worm gear will not reengage and mesh with the teeth of the worm wheel when the slats are to be tilted to a partially open or fully open position from the fully closed position.

It is therefore an object of my invention to provide for a tilter mechanism which will insure that only predetermined forces may be applied to the tilter mechanism at the limit of rotation or tilt of the slats in order to prevent binding or jamming of the mechanism.

It is a further object of my invention to provide for a tilt mechanism which has a worm gear and a toothed worm wheel which will reengage and mesh together upon application of forces to tilt the slats from the fully tilted and closed position to a partially open or fully open position.

DESCRIPTION OF THE INVENTION

Broadly a tilter mechanism constructed according to my invention has a worm gear which is rotatably mounted in a first mounting means and which normally engages and meshes with a toothed worm wheel which is rotatably mounted in a second mounting means. Resilient means are provided for allowing disengagement and slippage to occur between the worm gear and toothed worm wheel when forces resisting rotation of the worm wheel exceed a predetermined value. The worm wheel has a consecutive series of teeth of less height than the remainder of the teeth with the resilient means allowing disengagement between the worm wheel and the worm gear when the worm gear meshes with the teeth of the worm wheel of lesser height.

Preferably the series of teeth of lesser height mesh with the worm gear at a limit of tilt of the slats of the slatted blind. In some instances the consecutive series of teeth of lesser height may mesh with the worm gear at either one of two opposite limits of tilt of the slats or the worm wheel may have two consecutive spaced series of teeth of lesser height with each series being adapted to mesh with the worm gear at one of two limits of tilt of the slats.

Preferably the resilient means are integral with at least one of the mounting means such that the worm wheel and worm gear may move relatively away from each other to allow disengagement of the teeth of lesser height from the worm gear so that on continued application of a tilting force, the worm gear will slide or slip over the teeth of lesser height to act as a slip clutch. Conviently the resilient means and integral mounting means may comprise two opposite side walls of a tilter housing where at least one of the side walls is resilient.

A side wall may have interruptions in the body thereof to increase its resiliency to allow movement of the worm wheel and worm gear relatively away from each other.

BRIEF DESCRIPTION OF THE DRAWINGS

FIG. 1 is a cross-sectional view of a tilter housing having a tilter mechanism therein constructed according to the invention;

FIG. 2 is an exploded perspective view of the tilter housing of FIG. 1 illustrating a toothed worm wheel and worm gear according to the invention; and FIG. 3 is an enlarged cross-sectional end view of the worm wheel illustrated in FIG. 2.

DESCRIPTION OF THE PREFERRED EMBODIMENT

Referring to the drawings, there is illustrated a conventional U-shaped headrail 1 having a tilter housing 2 mounted threin. A worm gear 3 is rotatably journalled in the top wall 4 and the bottom wall 5 of the housing such that the top and bottom walls serve as a first mounting means for rotatably mounting the worm gear.

A toothed worm wheel 10 is rotatably journalled in side walls 11 and 12 of the housing such that the side walls form a second mounting means rotatably mounting the toothed worm wheel. The toothed wheel has an opening 13 or socket end adapted to receive a tilt bar 14 forming part of a conventional tilt system of a slatted blind assembly, not shown.

The top and bottom walls of the housing, as well as the side walls of the housing, are as shown, made of a plastic material such that the walls are resilient. The resiliency of the walls will allow some relative movement of the worm gear and toothed worm wheel away from each other on application of forces causing the teeth of the worm wheel to rise up on the teeth of the worm gear. This occurs when there is a resistance to rotation of the worm wheel, as may result from when slats of a slatted blind, not shown, reach their limit of rotation and where there is a continued application of a rotating force applied to the worm gear 3.

In order to limit the application of force that may be applied to the tilter mechanism comprising the worm gear and toothed worm wheel, a consecutive series of teeth 20 of the worm wheel are of lesser height than the height of the remaining teeth 21. If the worm wheel 10 is subjected to forces resisting rotation when the teeth 20 are in engagment with the worm gear 3, the teeth of the worm wheel will move relatively outwardly from the worm gear so that the teeth of the worm gear will slip or slide over the teeth 20. At this point the mechanism acts as a slip clutch preventing undue forces being applied by the worm gear to the worm wheel, tilter bar 13, and consequently to the slats, not shown, which could result in jamming or binding of the tilter system.

The teeth 20 will reengage with the teeth of the worm gear upon release of the forces causing the worm wheel and worm gear to move relatively apart as will occur when turning forces are no longer applied to the worm gear. Reengagement of teeth 20 with the teeth of the worm gear will insure that teeth 21 of the worm wheel will engage in proper mesh with the teeth of the worm gear. Thus, as contrasted with the prior art constructions as described earlier, the worm wheel will always reengage properly with the worm wheel upon removal or reversal of forces applied by the worm gear as occurs when the slats are tilted in an opposite direction, i.e. from a fully closed position towards a partially open or fully open position.

Preferably the series of consecutive teeth 20 are positioned on wheel 10 so as to coincide with the portion of the wheel when the slats are at their limit of tilt, as may occur at the fully closed position of the slats, and so the teeth 20 are engaging the worm gear. In some instances it may be desirable to have a second series of consecutive teeth of lesser height on the worm wheel to provide for a second limit position of slat tilt, i.e. when slats may be tilted through 180° from one completely closed position to an opposite completely closed position.

In order to increase the resiliency of a mounting means, one or more of the walls forming the mounting means may be interrupted, as by slits 15, (which could be a through going slit) adjacent to the area where gear wheel is journalled. While as shown in FIG. 2 the slits are in the side walls and thus would increase the resiliency of the side walls to allow the worm wheel to move outwardly of the worm gear, slits could be included instead or in addition in the top and bottom of the housing to allow the worm gear to move.

A tilter mechanism constructed according to the invention is applicable for use with either horizontal or vertical slatted blinds.

I claim:

1. Tilter mechanism for a slatted blind, said mechanism comprising a worm gear, first mounting means rotatably mounting said worm gear, a toothed worm wheel, second mounting means rotatably mounting said worm wheel and in normal meshing engagment with said worm gear, and resilient means allowing temporary disengagement and slippage to occur between said worm gear and said worm wheel when forces resisting rotation of said worm wheel exceed a predetermined value, said worm wheel having a consecutive series of teeth of less height than the remainder of the teeth with said resilient means allowing disengagement between said worm wheel and said worm gear when said worm gear meshes with said teeth of lesser height at a force level less than that required to allow disengagement of said remainder of teeth from said worm gear.

2. Tilter mechanism according to claim 1 wherein the series of teeth of lesser height mesh with the worm gear at a limit of tilt of the slats of the slatted blind.

3. Tilter mechanism according to claim 1 wherein said resilient means are integral with at least one of said mounting means.

4. Tilter mechanism according to claim 3 wherein said resilient means and integral mounting means comprise two oposite side walls of a tilter housing wherein at least one side wall is resilient.

5. A tilter mechanism according to claim 4 wherein said at least one side wall has interruptions in the body thereof to increase resiliency.

* * * * *